United States Patent [19]

Ishigure

[11] Patent Number: 4,805,502

[45] Date of Patent: Feb. 21, 1989

[54] SHEET MATERIAL SLOTTING DEVICE

[75] Inventor: Masaaki Ishigure, Aichi, Japan

[73] Assignee: Isowa Inductry Co., Ltd., Aichi, Japan

[21] Appl. No.: 189,999

[22] Filed: May 4, 1988

[30] Foreign Application Priority Data

Jun. 4, 1987 [JP] Japan ..... 62-140186

[51] Int. Cl.[4] ..... B26D 1/56; B65H 35/02

[52] U.S. Cl. ..... 83/332; 83/677; 493/370; 493/471; 493/475

[58] Field of Search ..... 493/365, 367, 369, 370, 493/471, 475; 83/332, 677

[56] References Cited

U.S. PATENT DOCUMENTS

| | | | |
|---|---|---|---|
| 1,567,656 | 12/1925 | Langston | 493/370 |
| 2,181,197 | 11/1939 | Moritz | 83/677 |
| 3,466,982 | 9/1969 | Sullivan | 83/332 |

*Primary Examiner*—Frederick R. Schmidt
*Assistant Examiner*—Jack W. Lavinder
*Attorney, Agent, or Firm*—Koda and Androlia

[57] ABSTRACT

Disclosed is a sheet material slotting device provided with an upper slotter shaft and a lower slotter shaft, in a vertical relationship, which rotate in opposite directions to each other in synchronization with the speed of feeding the sheet material; and an upper slotting knife disposed relative to a ring attached to the upper slotter shaft and also a pair of lower slotting knives disposed relative to a ring attached to the lower slotting shaft, with a predetermined space therebetween, in the axial direction and having a constitution in which slotting of a sheet material is carried out under cooperation of the upper slotting knife with the lower slotting knives characterized in that said slotting device comprises:

an eccentric member fitted to the upper slotter shaft having an axis deviated from the axis of said shaft;

a holder pivotally fitted with play around the outer periphery of this eccentric member and having the upper slotting knife fixed thereon so that the edge of said knife may be extended outwardly in the radial direction from the circumferential surface of the ring; and a turning means for allowing said holder to turn relative to said eccentric member;

and that said device has a constitution wherein selection can be made between the position where the edge of the upper slotting knife fixed to said holder is extended outwardly in the radial direction from the circumferential surface of said ring and the position where said edge is retracted inwardly in the radial direction from the circumferential surface of said ring.

2 Claims, 8 Drawing Sheets

SHEET MATERIAL SLOTTING DEVICE

FIELD OF THE INVENTION

This invention relates to a sheet material slotting device, more particularly to a slotting device which performs a required process of slotting on a corrugated board sheet for obtaining a blank for case making, which can afford smooth feeding of said sheet irrespective of its size even when said sheet is just passed through said sheet without application of any slotting process thereto.

BACKGROUND OF THE INVENTION

In order to make a case from a corrugated board sheet which has been cut out into predetermined dimensions, it is necessary to prepare a blank, preliminarily, to which required procedures of slotting and creasing have been applied, and a composite device of so-called flexographic printer slotting device is suitably used for such purposes. This device is constituted of units, for example, a flexographic printer, creaser, slotter, etc., which are serially aligned, and designed to carry out the required printing, as well as creasing, slotting, etc. successively against corrugated board sheets which are fed through each of these units.

This invention relates to an improvement of a slotting device (hereinafter referred also to as "slotter"). Therefore, the mechanism of this slotter will first be outlined. FIG. 7 shows a slotter to be incorporated into the flexographic printer slotter, said slotter has a slotting means 10, provided inside thereof, comprising an upper slotting knife 14 and a pair of lower slotting knives 16 disposed, in a vertical relationship. When a corrugated board sheet 12 is fed horizontally through the clearance between the upper slotting knife and the lower slotting knives 16, the desired slotting process can be achieved at the end portion of said sheet 12 along the widthwise direction. It should be noted that two slotters are serially aligned in the line of feeding the corrugated board sheets 12, since a multiplicity of slotting procedures are applied to the corrugated board sheet 12 to form slots along its widthwise direction.

As shown in FIG. 7, an upper slotter shaft 18 and a lower slotter shaft 20 each rotating in opposite directions in synchronization with the speed of feeding the corrugated board sheet 12 are disposed, in a vertical relationship, in the frame (not shown) of the slotter. To the two shafts 18 and 20, rings 22 and 24 are attached, respectively, each comprising an annular plate having a predetermined thickness, to oppose to each other by means of setscrews 26. In this connection, the clearance between the two rings 22 and 24 is preliminarily adjusted such that it may substantially correspond to the thickness of the corrugated board sheet 12, and thus the corrugated board sheet 12 fed to these two rings 22 and 24 is supported therebetween and can be fed downstream of the line of feed.

As shown in FIG. 8, the sectorial upper slotting knife 14 is fixed by means of bolts 28 on the left side of the ring 22 attached to said upper slotter shaft 18, in such a state that its edge 14*a* may slightly be extended outwardly in the radial direction from the circumferential surface of said ring. Also, a pair of lower slotting knives 16 are fitted by means of bolts 32 on the left side (on the same side that the above upper slotting knife 14 is fixed) of the ring 24 attached to the lower slotter shaft 20, such that a spacer 30 having a thickness slightly greater than that of the upper slotting knife 14 may be sandwiched therebetween. When the upper slotter shaft 18 and the lower slotter shaft 20 are rotated in directions opposing to each other, said upper slotting knife 14 intrudes between the two lower slotting knives 16 to achieve the required slotting process for the corrugated board sheet 12 having been fed to said upper nd lower slotting knives 14 and 16. In this connection, a pair of feed rollers 34 are disposed, in vertical relationships, upstream and downstream of the line relative to the slotting device 10, respectively, as shown in FIG. 7, and the corrugated board sheet 12 is substantially fed by means of these feed rollers.

As described above, it is often required generally to apply printing process to the corrugated board sheet 12 prior to being subjected to the necessary creasing and slotting processes which are required in case making. However, depending on the users of the flexographic printer slotter, it is sometimes necessary to pass on said printed corrugated board sheet 12 to feed it out of the line without application of the slotting process thereto. In such an occasion, it is contemplated that the corrugated board sheet 12 is passed through the slotter and fed out of the line in such a state that the slotting operation may be unapplicable to the corrugated board sheet 12 by ascending the upper slotter shaft 18 to a position at which said upper slotting knife 14 may not be in contact with said sheet 12.

However, for achieving this, not only a complicated mechanism is required for ascending the upper slotter shaft 18, but also the width of the corrugated board sheet 12 which can be fed through said slotter is limited, disadvantageously. To describe in detail, feeding of the corrugated board sheet 12 is carried out by the feed rollers 34 disposed upstream and downstream of the line, respectively, relative to the upper slotter shaft 18 and the lower slotter shaft 20, and the respective rings 22 and 24 attached thereto. Accordingly, when the sheet 12 is subjected to the slotting process, the corrugated board sheet 12 can be fed by the rings 22 and 24 and slotted being supported therebetween, whereby the minimum width of said sheet 12 may be almost correspond to the distance $l_1$ (see FIG. 7), i.e. the distance from the center of the ring 22 or 24 to the center of the feed roller 34.

However, if the upper slotter shaft 18 is ascended, feeding of the corrugated board sheet 12 by means of the two rings 22 and 24 is no more possible. Therefore, the minimum width of the sheet 12 which can be fed through the slotter may naturally be equal to the distance $l_2$ ($l_2=2\times l_1$), i.e. the distance from the center of the roller 34 disposed upstream of the line of feeding the sheet 12 to the center of the roller 34 disposed downstream thereof relative to the slotting device 10, and a sheet having a width of shorter than $l_2$ cannot be fed therethrough, disadvantageously.

It has been attempted to retract all of the rings 22 toward the frame by sliding them along the upper slotter shaft 18 to define a zone in the center of the sheet feeding area, in which the upper slotting knives 14 do not interfere with the corrugated board sheet 12, as another measure for allowing the corrugated board sheet 12 to pass through this zone. However, in such attempt, the sheet 12 cannot be fed by the rings 22 and 24 being supported thereby, and the problem that the width of the corrugated board sheet 12 is limited still remains unsolved.

Thus, it is practiced to feed the corrugated board sheet 12 by means of circumferential surfaces disposed in an area outside of the area where the upper slotting knife 14 provided on the ring 22 are disposed. Such embodiment involves a disadvantage that it can be applied only to a corrugated board sheet 12 having extremely small width. It can also be contemplated to remove all of the upper slotting knives 14 provided in the slotter. In such embodiment, when a corrugated board case of Type A (as stipulated in JIS), for example, is to be prepared, four upper slotting knives 16 are required per one upper slotter shaft 18. Accordingly, eight upper slotting knives 14 must be removed from said shaft to make the operation extremely complicated and time-consuming, disadvantageously.

It can also be contemplated to retract traversely the slotter unit from the flexographic printer slotter mentioned above to be out of the line. However, such embodiment involves problems that a space must be secured for resting the unit having been removed from the line, and that an additional operation is also necessary for stopping the flow of line, which is time-consuming.

OBJECT OF THE INVENTION

This invention has been proposed in view of these various disadvantages inherent in the prior art slotting devices as mentioned above and for overcoming them successfully, and is directed to provide a means for feeding said sheet material easily, when slotting process is not required, irrespective of the size of said sheet, without stopping the operation of the line for an extended period of time.

SUMMARY OF THE INVENTION

With a view to overcoming the above problems and achieving the intended object successfully, this invention provides a slotting device having a constitution in which slotting of a sheet material is carried out under cooperation of the upper slotting knife with the lower slotting knives, by providing an upper slotter shaft and a lower slotter shaft, in a vertical relationship, which rotate in opposite directions to each other in synchronization with the speed of feeding the sheet material; and an upper slotting knife disposed relative to a ring attached to the upper slotter shaft and also a pair of lower slotting knives disposed on a ring attached to the lower slotting shaft with a predetermined space therebetween in the axial direction, characterized in that said slotting device comprises an eccentric member fitted around the upper slotter shaft, having an axis deviated from the axis of said shaft; a holder pivotally fitted with play to the outer periphery of this eccentric member and having the upper slotting knife fixed thereon so that the edge of said knife may be extended outwardly in the radial direction from the circumferential surface thereof; and a turning means for allowing said holder to turn relative to said eccentric member; and that said device has a constitution wherein selection can be made between the position where the edge of the upper slotting knife fixed to said holder is extended outwardly in the radial direction from the circumferential surface of said ring and the position where said edge is retracted inwardly in the radial direction from the circumferential surface of said ring.

According to the sheet material cutting device of this invention, aplication of slotting process can be selected using a simple operation to turn the holder on which the upper slotting knife is fixed with a predetermined angle. Also, when slotting process is not applied, feeding of the corrugated board sheet can be effected without any trouble. Thus, the present sheet material cutting device exhibits excellent effects of improving working efficiency and so on, since it can cover a sheet having a small width and the edge position can be shifted speedily.

BRIEF DESCRIPTION OF THE DRAWINGS

The drawings show an embodiment of the sheet material slotting device according to this invention, wherein.

DETAILED DESCRIPTION OF THE INVENTION

Figure 7:
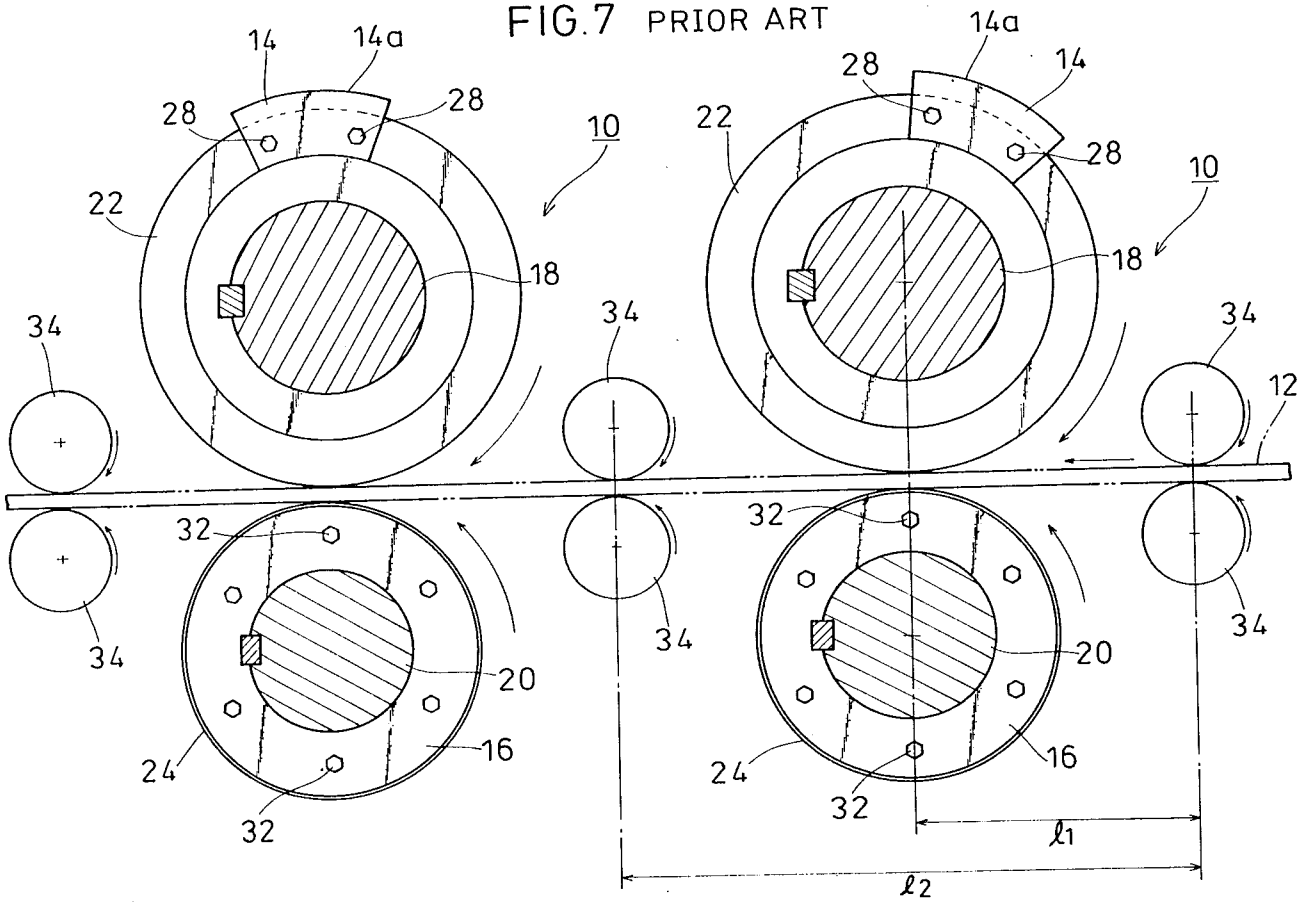
FIG. 7 PRIOR ART
FIG. 7 is a front sectional view of a prior art slotting device.
Figure 8:
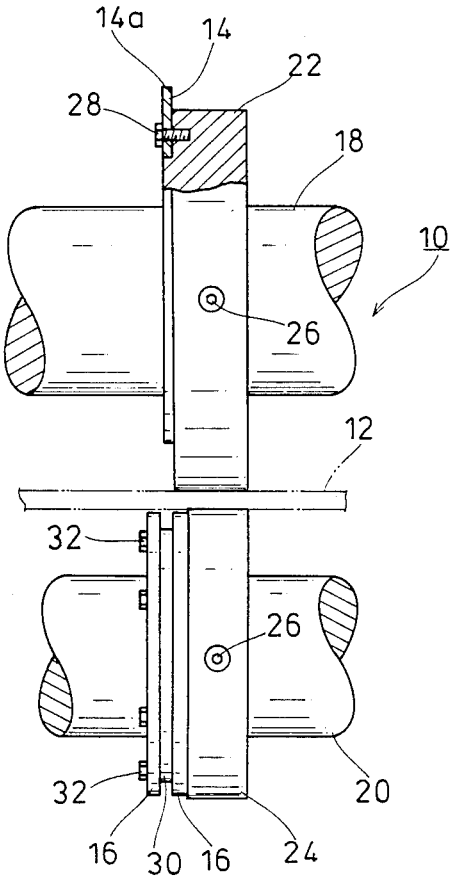
FIG.8 PRIOR ART
FIG. 8 is a right side view of the device shown in FIG. 7.

Next, the sheet material slotting device according to this invention will be described below by illustrating a preferred embodiment and referring to the attached drawings. It should be noted that the members in the prior art slotter described referring to FIGS. 7 and 8 which are similar to those mentioned referring to the device of this invention are shown by attaching the same referential numbers, respectively, and detailed description thereon have been omitted.

Figure 1:
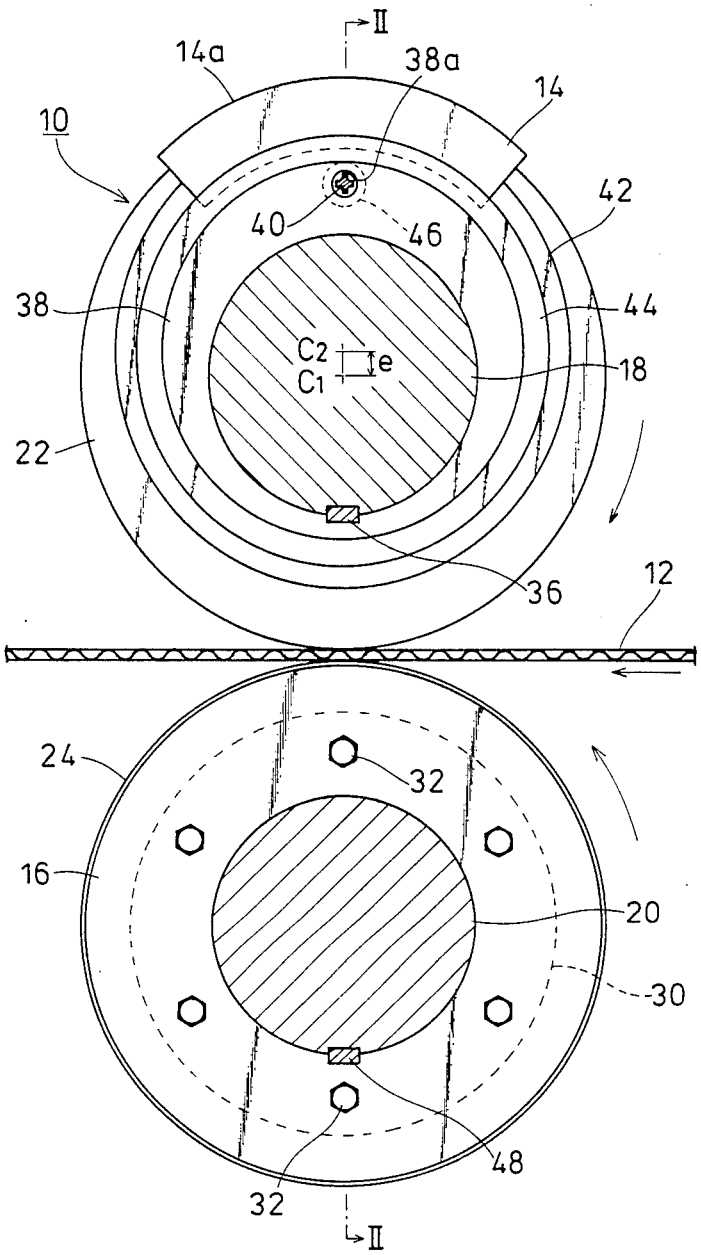
FIG. 1 is a front sectional view of the slotting device according to this invention.
Figure 2:
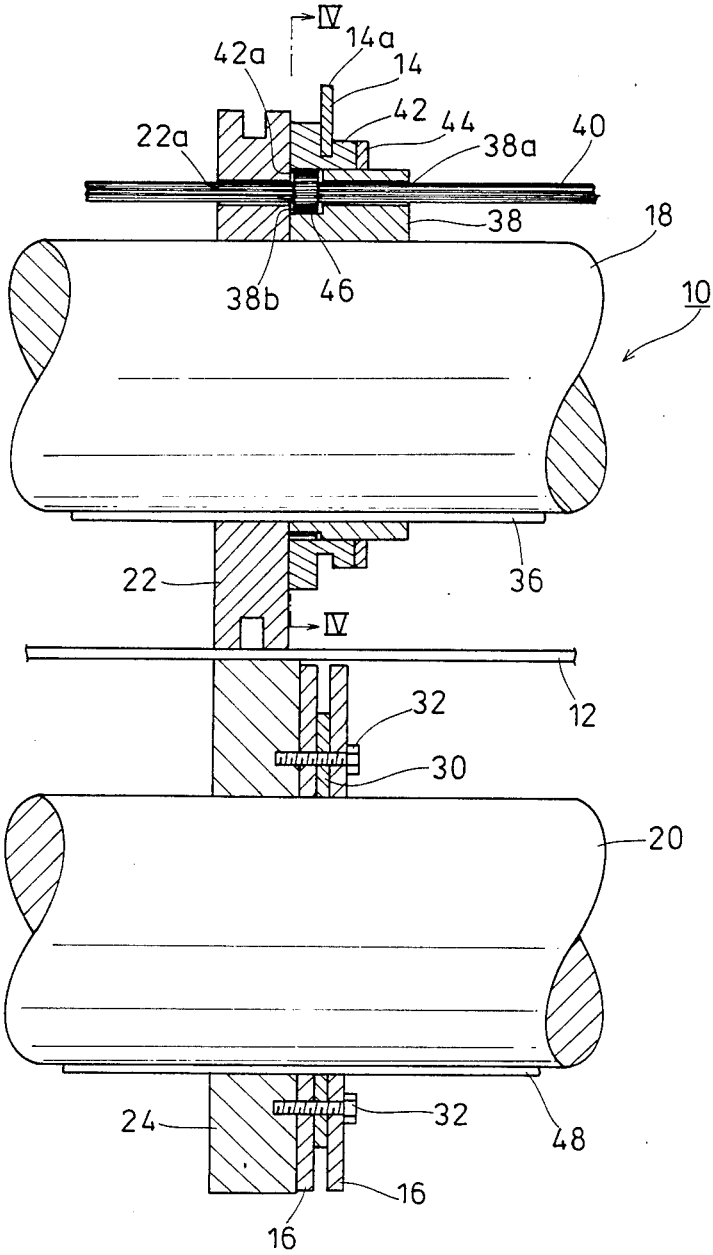
FIG. 2 is a cross-sectional view taken along the line II—II in FIG. 1.

FIG. 1 is a front sectional view of the slotting device according to this invention; and FIG. 2 is a cross-section taken along the line II in FIG. 1. As shown in Figures, a ring 22 is disposed through a key 36 and a lock mechanism (not shown) on an upper slotter shaft 18 such that said ring 22 may be shifted, for making adjustment, with a required distance along the axis of said upper slotter shaft 18, and an eccentric member 38 is disposed on the right side (referring to FIG. 2) of this ring 22. This eccentric member 38 is set so that its axis $C_2$ may be deviated with a distance e from the axis $C_1$ of the upper slotter shaft 18 and fitted around the upper slotter shaft 18, as shown in FIG. 1. Through-holes **22*a* and 38*a* opposing to each other are provided, as shown in FIG. 2, on the ring 22 and the eccentric member 38, respectively, through which a spline shaft 40 constituting a turning means to be described later is inserted. A circumferential groove 38*b* is also provided along the circumference of the eccentric member 38 on the side at which it is in contact with the side of the ring 22, and a gear 46 attached to the spline shaft 40 is received in said groove 38*b***.

Figure 4:
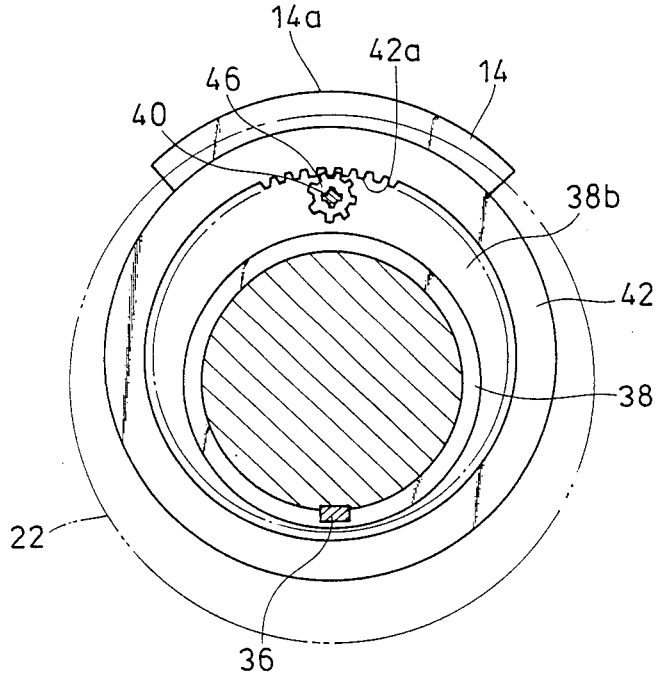
FIG. 4 is a cross-sectional view taken along the line IV—IV in FIG. 2.

A holder 42 is pivotally fitted with play around the periphery of the eccentric member 38, and an internal gear **42*a* is formed around the internal periphery of said holder 42 at a portion opposing to said circumferential groove 38***b* (see FIG. 4). Also, an annular regulating member 44 is fixed to the eccentric member 38, and the holder 42 is supported between said regulating member 44 and said ring 22 to regulate position of the holder in axial direction. In this connection, the size of the holder 42 is set such that the periphery thereof may not extend outwardly in the radial direction from the circumferential surface of the ring 22.

To the holder 42, provided is a sectorial upper slotting knife 14 having an edge 14*a* extending outwardly in the radial direction of said holder 42, such that the upper slotting knife 14 may achieve slotting process relative to a corrugated board sheet 12 in cooperation with the lower slotting knives 16 to be described later, wherein the height that the upper slotting knife 14 is extended from the circumferential surface of the holder 42 has preliminarily been set to a level, in which selection can be made between the position where the edge 14*a* is extended outwardly in the radial direction from the circumferential surface of the ring 22 when said holder 42 is turned with 180 degree around the periphery of the eccentric member 38 by use of a turning means to be described later (see FIG. 1) and the position where said edge 14*a* is retracted in the radial direction from the circumferential surface of the ring 22.

Figure 3:
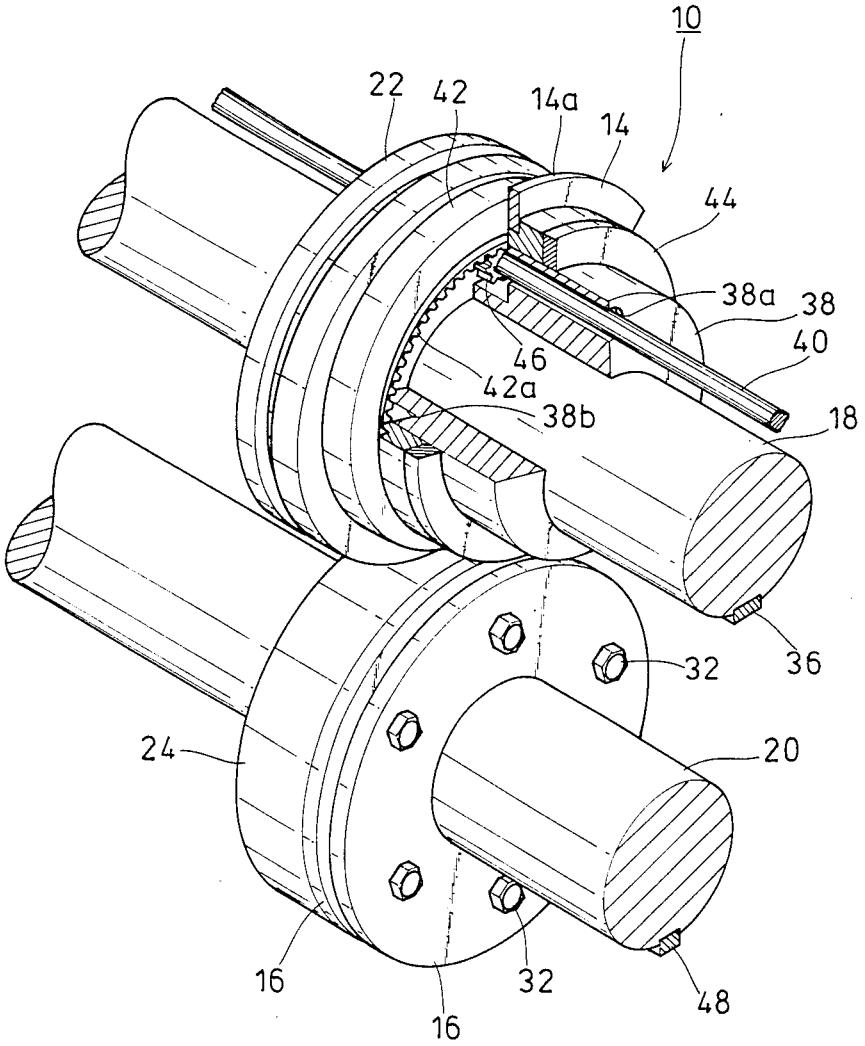
FIG. 3 is a perspective partially cutaway view showing schematically the structure of the device shown in FIG. 1.

As shown in FIGS. 2 and 3, the spline shaft 40 constituting the turning means for the holder 42 is disposed parallel with the upper slotter shaft 18 in the frame of the slotter (not shown) and designed to turn around said upper slotter shaft 18 as said upper slotter shaft rotates. The gear 46 is attached to this spline shaft 40 at a position so that it may be received in the circumferential groove 38*b* formed in the eccentric member 38, and the gear 46 is engaged with the internal gear 42*a* of the holder 42, whereby the holder 42 can be turned around the eccentric member 38 under engagement of the gear 46 with the internal gear 42*a*, when the spline shaft 40 is turned to the predetermined position.

Also, when the ring 22 and the eccentric member 38 are shifted along the axis of the upper slotter shaft 18 with the order change in the corrugated board sheet 12, said gear 46 is also carried thereby in the axial direction, since the gear 46 is disposed to be slidable along the axis of the spline shaft 40.

As described above, a plurality of rings 22, eccentric members 38 and upper slotting knives 14 disposed relative to said rings 22 and the eccentric members 38 are provided along the upper slotter shaft 18, and one common spline shaft 40 is inserted through each of the rings 22 and the eccentric members 38. Accordingly, when the single spline 40 is turned, all of the upper slotting knives 14 fitted to said upper slotter shaft 18 can be turned simultaneously relative to the axis of the eccentric member 38.

As the driving mechanism for the spline shaft 40, which is not shown in the drawings, a gear, for example, is disposed at one end of the spline shaft 40, and an internal gear which engages with said gear is disposed in the frame, which gear is allowed to rotate, together with the upper slotter shaft 18, under engagement with the internal gear during normal operation. For shifting the position of the upper slotting knife 14, the rotation of the upper slotter shaft 18 is stopped, and also said internal gear is turned by means of a driving device. Thus, the gear which is in engagement with said internal gear is rotated to turn the spline shaft 40 and the gear 46 which is in engagement with the internal gear 42*a* of the holder 42 so that the holder 42 can be turned around the periphery of the eccentric member 38.

The mechanism in the part of receiving said upper slotting knife 14 has a constitution which is similar to that of a prior art slotting device, wherein a ring 24 is fixed to a lower slotter shaft 20 through a key 48 and a lock mechanism not shown. A pair of lower slotting kiives 16 are fixed to said ring 24 by means of bolts 32 so that the knives may support a spacer 30 therebetween. When the upper slotting knife 14 intrudes between said two lower slotting knives 16, an elongated slot can be formed in a corrugated board sheet 12. It should be noted that the spacer 30 is designed to have a diameter such that it may not interfere with the upper slotting knife 14 when it intrudes between the two lower slotting knives 16, as shown in the drawings.

Figure 5:
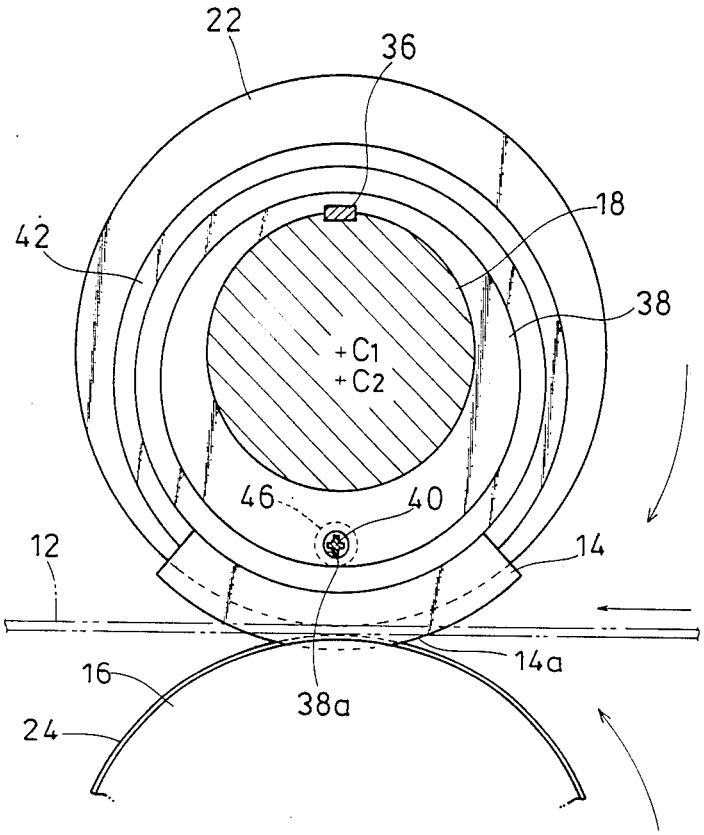
FIG. 5 is a partial front view shown in cross-section illustrating the state in which the upper slotter shaft having a posture shown in FIG. 1 is turned by 180 degree.

Next, practice of the so constituted slotting device according to this invention in actual uses will be explained. First of all, when a printed corrugated board sheet 12 is subjected to slotting process, the edge 14*a* of the upper slotting knife 14 is preliminarily set to extend outwardly in the radial direction from the circumferential surface of said ring 22, as shown in FIG. 1. When the upper slotter shaft 18 and the lower slotter shaft 20 are rotated in opposite directions to each other while the edge 14*a* of the upper slotting knife 14 is maintained in such posture, the edge 14*a* of the upper slotting knife 14 intrudes between the lower slotting knives 16 as shown in FIG. 5 to achieve required slotting process. During this process, the corrugated board sheet 12 is fed securely, since it is supported between the two rings 22 and 24 attached to the upper slotter shaft 18 and the lower slotter shaft 20.

Figure 6:
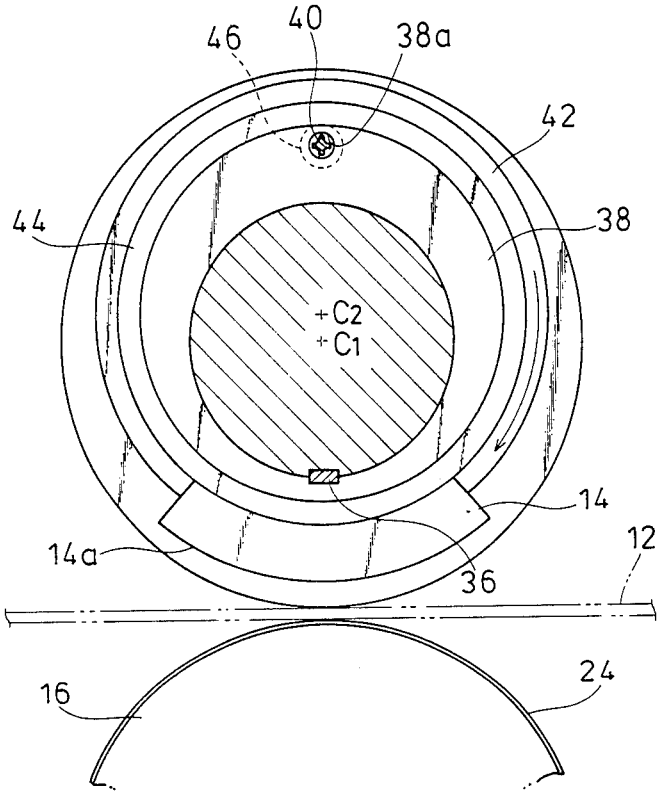
FIG. 6 is a partial front view shown in cross-section illustrating the state in which only the holder having a posture shown in FIG. 1 is turned by 180 degree.

Next, when the printed corrugated board sheet 12 is to be passed through the slotter without application of the slotting process to be delivered out of the device, the spline shaft 40 is turned clockwise by means of said driving means (not shown). In this process, since the gear 46 attached to the spline shaft 40 and the internal gear 42*a* of the holder 42 are engaged with each other, the holder 42 is turned clockwise around the periphery of the eccentric member 38. When the holder 42 is turned by 180 degree as shown in FIG. 6, the edge 14*a* of the upper slotting knife 14 provided on the holder 42 is retracted inwardly in the radial direction relative to said ring 22 to avoid interfering with the corrugated board sheet 12 to be fed through the two shafts 18 and 20. Subsequently, when the rotation of the spline shaft is stopped, the holder 42 is positioned and fixed on the eccentric member 38 under engagement of the gear 46 with the internal gear 42*a*. It should be noted that, while a plurality of upper slotting knives 14 are provided along the upper slotter shaft 18, the shifting operation can be carried out in a brief time since the respective upper slotting knives 14 are moved by means of one common spline shaft 40.

The two shafts 18 and 20 start to rotate by starting the operation of the slotter after making the adjustment as mentioned above, but the upper slotting knives 14 will never be in contact with the corrugated board sheet 12 to be fed through the two shafts 18 and 20, thereby no slotting process will be applied to said sheet 12. During this process, the feeding of the corrugated board sheet 12 is feasible by means of the two rings 22 and 24, since the position of said ring 22 or 24 is not changed.

What is claimed is:

1. A sheet material slotting device provided with an upper slotter shaft and a lower slotter shaft, in a vertical relationship, which rotate in opposite directions to each other in synchronization with the speed of feeding the sheet material; and an upper slotting knife disposed relative to an upper ring attached to the upper slotter shaft and also a pair of lower slotting knives disposed relative to a ring attached to the lower slotting shaft, with a lower predetermined space therebetween, in the axial direction and having a constitution in which slotting of a sheet material is carried out under cooperation of the upper slotting knife with the lower slotting knives characterized in that said slotting device comprises:

an eccentric member fitted to the upper slotter shaft having an axis deviated from the axis of said upper slotter shaft;

a holder pivotally fitted with play around the outer periphery of this eccentric member and having the upper slotting knife fixed thereon so that the edge of said knife may be extended outwardly in the radial direction from the cicumferential surface of the upper ring; and a turning means for allowing said holder to turn relative to said eccentric member;

and that said device has two positions wherein selection can be made between a first of second position wherein at said first position the edge of the upper slotting knife fixed to said holder is extended outwardly in the radial direction from the circumferential surface of said upper ring so that the upper slotter knife will engage with the lower slotter knives to produce a slot in the sheet material and wherein at said second position the position where said edge is retracted inwardly in the radial direction from the circumferential surface of said upper ring so that the edge of the upper slotter knife does not extend beyond said upper ring.

2. The sheet material slotting device according to claim 1, wherein said turning means comprises:

a spline shaft disposed parallel with the upper slotter shaft;

a gear attached to said spline shaft to be slidable along the axis of said shaft; and an internal gear which is formed along the internal periphery of said holder and engages with said gear.

* * * * *

UNITED STATES PATENT AND TRADEMARK OFFICE

CERTIFICATE OF CORRECTION

PATENT NO. : 4,805,502

DATED : Feb. 21, 1989

INVENTOR(S) : Masaaki Ishigure

It is certified that error appears in the above—identified patent and that said Letters Patent is hereby corrected as shown below:

On the Title Page,
In Item [73], change "Assignee: Isowa Inductry Co., Ltd., Aichi, Japan" to --Assignee: Isowa Industry Co., Ltd., Aichi, Japan--

Signed and Sealed this

Eleventh Day of July, 1989

*Attest:*

*Attesting Officer*

DONALD J. QUIGG

*Commissioner of Patents and Trademarks*